US009608345B2

(12) United States Patent
Ehret et al.

(10) Patent No.: US 9,608,345 B2
(45) **Date of Patent: *Mar. 28, 2017**

(54) CONTINUITY MAINTAINING BIASING MEMBER

(71) Applicant: PPC Broadband, Inc., East Syracuse, NY (US)

(72) Inventors: Trevor Ehret, North Haven, CT (US); Richard A. Haube, Cazenovia, NY (US); Noah Montena, Syracuse, NY (US); Souheil Zraik, Liverpool, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/913,043

(22) Filed: Jun. 7, 2013

(65) Prior Publication Data

US 2013/0273761 A1 Oct. 17, 2013

Related U.S. Application Data

(63) Continuation of application No. 13/726,330, filed on Dec. 24, 2012, now Pat. No. 8,480,430, which is a (Continued)

(51) Int. Cl.
*H01R 9/05* (2006.01)
*H01R 24/40* (2011.01)

(Continued)

(52) U.S. Cl.
CPC ..... *H01R 9/0521* (2013.01); *H01R 4/48* (2013.01); *H01R 9/05* (2013.01); *H01R 9/0527* (2013.01);

(Continued)

(58) Field of Classification Search
CPC .. H01R 24/40; H01R 13/5202; H01R 9/0521; H01R 9/0524

(Continued)

(56) References Cited

U.S. PATENT DOCUMENTS 331,169 A 11/1885 Thomas
1,371,742 A 3/1921 Dringman (Continued)

FOREIGN PATENT DOCUMENTS

CA 2096710 A1 11/1994
CN 101060690.00 A 10/2007

(Continued)

OTHER PUBLICATIONS

Digicon AVL Connector. Arris Group Inc. [online]. 3 pages [retrieved on Apr. 22, 2010]. Retrieved from the Internet:< URL: http://www.arrisi.com/special/digiconAVL.asp>.

(Continued)

*Primary Examiner* — Briggitte R Hammond
(74) *Attorney, Agent, or Firm* — Barclay Damon, LLP

(57) ABSTRACT

A post having a first end, a second end, and a flange proximate the second end, wherein the post is configured to receive a center conductor surrounded by a dielectric of a coaxial cable, a connector body attached to the post, a coupling element attached to the post, the coupling element having a first end a second end, and a biasing member disposed within a cavity formed between the first end of the coupling element and the connector body to bias the coupling element against the post is provided. Moreover, a connector body having a biasing element, wherein the biasing element biases the coupling element against the post, is further provided. Furthermore, associated methods are also provided.

19 Claims, 9 Drawing Sheets

Related U.S. Application Data continuation of application No. 13/075,406, filed on Mar. 30, 2011, now Pat. No. 8,366,481.

(51) Int. Cl.

| | |
|---|---|
| ***H01R 13/52*** | (2006.01) |
| ***H01R 43/00*** | (2006.01) |
| ***H01R 43/16*** | (2006.01) |
| ***H01R 43/26*** | (2006.01) |
| ***H01R 4/48*** | (2006.01) |
| ***H01R 13/62*** | (2006.01) |
| ***H01R 13/502*** | (2006.01) |
| *H01R 43/20* | (2006.01) |
| *H01R 13/622* | (2006.01) |

(52) U.S. Cl.

CPC ..... *H01R 13/5025* (2013.01); *H01R 13/62* (2013.01); *H01R 43/00* (2013.01); *H01R 43/16* (2013.01); *H01R 43/26* (2013.01); *H01R 13/5202* (2013.01); *H01R 13/622* (2013.01); *H01R 43/20* (2013.01); *Y10T 29/49174* (2015.01); *Y10T 29/49204* (2015.01); *Y10T 29/49208* (2015.01)

(58) Field of Classification Search

USPC ..... 439/584–587

See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,013,526 | A | 9/1935 | Schmitt |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,665,729 | A | 1/1954 | Terry |
| 2,694,187 | A | 11/1954 | Nash |
| 2,694,817 | A | 11/1954 | Roderick |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,816,949 | A | 12/1957 | Curtiss |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,870,978 | A | 3/1975 | Dreyer |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |

(56) References Cited

U.S. PATENT DOCUMENTS 4,131,332 A 12/1978 Hogendobler et al.
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Boutros
4,193,655 A 3/1980 Herrmann, Jr.
4,194,338 A 3/1980 Trafton
4,213,664 A 7/1980 McClenan
4,225,162 A 9/1980 Dola
4,227,765 A 10/1980 Neumann et al.
4,229,714 A 10/1980 Yu
4,250,348 A 2/1981 Kitagawa
4,280,749 A 7/1981 Hemmer
4,285,564 A 8/1981 Spinner
4,290,663 A 9/1981 Fowler et al.
4,296,986 A 10/1981 Herrmann et al.
4,307,926 A 12/1981 Smith
4,322,121 A 3/1982 Riches et al.
4,326,769 A 4/1982 Dorsey et al.
4,339,166 A 7/1982 Dayton
4,346,958 A 8/1982 Blanchard
4,354,721 A 10/1982 Luzzi
4,358,174 A 11/1982 Dreyer
4,359,254 A 11/1982 Gallusser
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,126 A 4/1988 Gutter et al.
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon

(56) References Cited

U.S. PATENT DOCUMENTS

| | | | |
|---|---|---|---|
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,073,129 | A | 12/1991 | Szegda |
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,494 | A | 5/1994 | Flanagan et al. |
| 5,318,459 | A | 6/1994 | Shields |
| 5,321,205 | A | 6/1994 | Bawa et al. |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawaguchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,435,751 | A | 7/1995 | Papenheim et al. |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,509,823 | A | 4/1996 | Harting et al. |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,571,028 | A | 11/1996 | Szegda |
| 5,586,910 | A | 12/1996 | Del Negro et al. |
| 5,595,499 | A | 1/1997 | Zander et al. |
| 5,598,132 | A | 1/1997 | Stabile |
| 5,607,325 | A | 3/1997 | Toma |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hsu |
| 5,702,263 | A | 12/1997 | Baumann et al. |
| 5,722,856 | A | 3/1998 | Fuchs et al. |
| 5,735,704 | A | 4/1998 | Anthony |
| 5,746,617 | A | 5/1998 | Porter, Jr. et al. |
| 5,746,619 | A | 5/1998 | Harting et al. |
| 5,769,652 | A | 6/1998 | Wider |
| 5,775,927 | A | 7/1998 | Wider |
| 5,863,220 | A | 1/1999 | Holliday |
| 5,877,452 | A | 3/1999 | McConnell |
| 5,879,191 | A | 3/1999 | Burris |
| 5,882,226 | A | 3/1999 | Bell et al. |
| 5,897,795 | A | 4/1999 | Lu et al. |
| 5,921,793 | A | 7/1999 | Phillips |
| 5,938,465 | A | 8/1999 | Fox, Sr. |
| 5,944,548 | A | 8/1999 | Saito |
| 5,951,327 | A | 9/1999 | Marik |
| 5,957,716 | A | 9/1999 | Buckley et al. |
| 5,967,852 | A | 10/1999 | Follingstad et al. |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,162,995 | A | 12/2000 | Bachle et al. |
| 6,210,216 | B1 | 4/2001 | Tso-Chin et al. |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,257,923 | B1 | 7/2001 | Stone et al. |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| 6,383,019 | B1 | 5/2002 | Wild |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |

(56) References Cited

U.S. PATENT DOCUMENTS

| | | | |
|---|---|---|---|
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,676,446 | B2 | 1/2004 | Montena |
| 6,683,253 | B1 | 1/2004 | Lee |
| 6,692,285 | B2 | 2/2004 | Islam |
| 6,692,286 | B1 | 2/2004 | De Cet |
| 6,705,884 | B1 | 3/2004 | McCarthy |
| 6,709,280 | B1 | 3/2004 | Gretz |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,752,633 | B2 | 6/2004 | Aizawa et al. |
| 6,767,248 | B1 | 7/2004 | Hung |
| 6,769,926 | B1 | 8/2004 | Montena |
| 6,769,933 | B2 | 8/2004 | Bence et al. |
| 6,780,029 | B1 | 8/2004 | Gretz |
| 6,780,052 | B2 | 8/2004 | Montena et al. |
| 6,780,068 | B2 | 8/2004 | Bartholoma et al. |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,817,897 | B2 | 11/2004 | Chee |
| 6,848,939 | B2 | 2/2005 | Stirling |
| 6,848,940 | B2 | 2/2005 | Montena |
| 6,873,864 | B2 | 3/2005 | Kai et al. |
| 6,882,247 | B2 | 4/2005 | Allison et al. |
| 6,884,113 | B1 | 4/2005 | Montena |
| 6,884,115 | B2 | 4/2005 | Malloy |
| 6,898,940 | B2 | 5/2005 | Gram et al. |
| 6,916,200 | B2 | 7/2005 | Burris et al. |
| 6,929,265 | B2 | 8/2005 | Holland et al. |
| 6,929,508 | B1 | 8/2005 | Holland |
| 6,939,169 | B2 | 9/2005 | Islam et al. |
| 6,948,976 | B2 | 9/2005 | Goodwin et al. |
| 6,971,912 | B2 | 12/2005 | Montena et al. |
| 7,004,788 | B2 | 2/2006 | Montena |
| 7,011,547 | B1 | 3/2006 | Wu |
| 7,029,304 | B2 | 4/2006 | Montena |
| 7,029,326 | B2 | 4/2006 | Montena |
| 7,063,565 | B2 | 6/2006 | Ward |
| 7,070,447 | B1 | 7/2006 | Montena |
| 7,074,081 | B2 | 7/2006 | Hsia |
| 7,086,897 | B2 | 8/2006 | Montena |
| 7,097,499 | B1 | 8/2006 | Purdy |
| 7,097,500 | B2 | 8/2006 | Montena |
| 7,102,868 | B2 | 9/2006 | Montena |
| 7,108,548 | B2 | 9/2006 | Burris et al. |
| 7,114,990 | B2 | 10/2006 | Bence et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,605 | B2 | 10/2006 | Montena |
| 7,131,867 | B1 | 11/2006 | Foster et al. |
| 7,131,868 | B2 | 11/2006 | Montena |
| 7,144,271 | B1 | 12/2006 | Burris et al. |
| 7,147,509 | B1 | 12/2006 | Burris et al. |
| 7,156,696 | B1 | 1/2007 | Montena |
| 7,161,785 | B2 | 1/2007 | Chawgo |
| 7,179,121 | B1 | 2/2007 | Burris et al. |
| 7,186,127 | B2 | 3/2007 | Montena |
| 7,189,113 | B2 | 3/2007 | Sattele et al. |
| 7,198,507 | B2 | 4/2007 | Tusini |
| 7,207,820 | B1 | 4/2007 | Montena |
| 7,229,303 | B2 | 6/2007 | Vermoesen et al. |
| 7,241,172 | B2 | 7/2007 | Rodrigues et al. |
| 7,252,546 | B1 | 8/2007 | Holland |
| 7,255,598 | B2 | 8/2007 | Montena et al. |
| 7,264,503 | B2 | 9/2007 | Montena |
| 7,299,520 | B2 | 11/2007 | Huang |
| 7,299,550 | B2 | 11/2007 | Montena |
| 7,300,309 | B2 | 11/2007 | Montena |
| 7,309,255 | B2 | 12/2007 | Rodrigues |
| 7,354,309 | B2 | 4/2008 | Palinkas |
| 7,371,112 | B2 | 5/2008 | Burris et al. |
| 7,371,113 | B2 | 5/2008 | Burris et al. |
| 7,375,533 | B2 | 5/2008 | Gale |
| 7,393,245 | B2 | 7/2008 | Palinkas et al. |
| 7,404,737 | B1 | 7/2008 | Youtsey |
| 7,442,081 | B2 | 10/2008 | Burke et al. |
| 7,452,237 | B1 | 11/2008 | Montena |
| 7,452,239 | B2 | 11/2008 | Montena |
| 7,455,549 | B2 | 11/2008 | Rodrigues et al. |
| 7,455,550 | B1 | 11/2008 | Sykes |
| 7,462,068 | B2 | 12/2008 | Amidon |
| 7,476,127 | B1 | 1/2009 | Wei |
| 7,479,033 | B1 | 1/2009 | Sykes et al. |
| 7,479,035 | B2 | 1/2009 | Bence et al. |
| 7,480,991 | B2 | 1/2009 | Khemakhem et al. |
| 7,488,210 | B1 | 2/2009 | Burris et al. |
| 7,494,355 | B2 | 2/2009 | Hughes et al. |
| 7,497,729 | B1 | 3/2009 | Wei |
| 7,507,117 | B2 | 3/2009 | Amidon |
| 7,513,795 | B1 | 4/2009 | Shaw |
| 7,544,094 | B1 | 6/2009 | Paglia et al. |
| 7,566,236 | B2 | 7/2009 | Malloy et al. |
| 7,568,945 | B2 | 8/2009 | Chee et al. |
| 7,607,942 | B1 | 10/2009 | Van Swearingen |
| 7,641,493 | B1 | 1/2010 | Lee |
| 7,644,755 | B2 | 1/2010 | Stoesz et al. |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,753,727 | B1 | 7/2010 | Islam et al. |
| 7,792,148 | B2 | 9/2010 | Carlson et al. |
| 7,794,275 | B2 | 9/2010 | Rodrigues |
| 7,798,849 | B2 | 9/2010 | Montena |
| 7,806,714 | B2 | 10/2010 | Williams et al. |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,828,596 | B2 | 11/2010 | Malak |
| 7,830,154 | B2 | 11/2010 | Gale |
| 7,833,053 | B2 | 11/2010 | Mathews |
| 7,837,501 | B2 | 11/2010 | Youtsey |
| 7,845,963 | B2 | 12/2010 | Gastineau |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,927,135 | B1 | 4/2011 | Wlos |
| 7,934,954 | B1 | 5/2011 | Chawgo et al. |
| 7,950,958 | B2 | 5/2011 | Mathews |

(56) References Cited

U.S. PATENT DOCUMENTS

| | | | |
|---|---|---|---|
| 7,955,126 | B2 | 6/2011 | Bence et al. |
| 7,972,158 | B2 | 7/2011 | Wild et al. |
| 8,029,315 | B2 | 10/2011 | Purdy et al. |
| 8,033,862 | B2 | 10/2011 | Radzil et al. |
| 8,062,044 | B2 | 11/2011 | Montena et al. |
| 8,062,063 | B2 | 11/2011 | Malloy et al. |
| 8,075,337 | B2 | 12/2011 | Malloy et al. |
| 8,075,338 | B1 | 12/2011 | Montena |
| 8,075,339 | B2 | 12/2011 | Holliday |
| 8,079,860 | B1 | 12/2011 | Zraik |
| 8,113,875 | B2 | 2/2012 | Malloy et al. |
| 8,152,551 | B2 | 4/2012 | Zraik |
| 8,157,588 | B1 | 4/2012 | Rodrigues et al. |
| 8,157,589 | B2 | 4/2012 | Krenceski et al. |
| 8,167,635 | B1 | 5/2012 | Mathews |
| 8,167,636 | B1 | 5/2012 | Montena |
| 8,167,646 | B1 | 5/2012 | Mathews |
| 8,172,612 | B2 | 5/2012 | Bence et al. |
| 8,186,919 | B2 | 5/2012 | Blair |
| 8,192,237 | B2 | 6/2012 | Purdy et al. |
| 8,206,176 | B2 | 6/2012 | Islam |
| 8,231,406 | B2 | 7/2012 | Burris et al. |
| 8,231,412 | B2 | 7/2012 | Paglia et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,323,053 | B2 | 12/2012 | Montena |
| 8,323,060 | B2 | 12/2012 | Purdy et al. |
| 8,328,577 | B1 | 12/2012 | Lu |
| 8,337,229 | B2 | 12/2012 | Montena |
| 8,348,697 | B2 | 1/2013 | Zraik |
| 8,366,481 | B2 | 2/2013 | Ehret et al. |
| 8,376,769 | B2 | 2/2013 | Holand et al. |
| 8,382,517 | B2 | 2/2013 | Mathews |
| 8,398,421 | B2 | 3/2013 | Haberek et al. |
| 8,414,322 | B2 | 4/2013 | Montena |
| 8,444,445 | B2 | 5/2013 | Amidon et al. |
| 8,469,740 | B2 | 6/2013 | Ehret et al. |
| 8,475,205 | B2 | 7/2013 | Ehret et al. |
| 8,480,430 | B2 | 7/2013 | Ehret et al. |
| 8,480,431 | B2 | 7/2013 | Ehret et al. |
| 8,485,845 | B2 | 7/2013 | Ehret et al. |
| 8,506,325 | B2 | 8/2013 | Malloy et al. |
| 8,517,763 | B2 | 8/2013 | Burris et al. |
| 8,529,279 | B2 | 9/2013 | Montena |
| 8,562,366 | B2 | 10/2013 | Purdy et al. |
| 8,597,041 | B2 | 12/2013 | Purday et al. |
| 8,888,526 | B2 | 11/2014 | Burris |
| 9,166,348 | B2 | 10/2015 | Burris et al. |
| 9,172,154 | B2 | 10/2015 | Burris |
| 2002/0013088 | A1 | 1/2002 | Rodrigues et al. |
| 2002/0038720 | A1 | 4/2002 | Kai et al. |
| 2003/0068924 | A1 | 4/2003 | Montena |
| 2003/0214370 | A1 | 11/2003 | Allison et al. |
| 2003/0224657 | A1 | 12/2003 | Malloy |
| 2004/0013096 | A1 | 1/2004 | Marinier et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0079762 | A1 | 4/2005 | Hsin |
| 2005/0159045 | A1 | 7/2005 | Huang |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Matthews |
| 2006/0154519 | A1 | 7/2006 | Montena |
| 2006/0166552 | A1 | 7/2006 | Bence et al. |
| 2006/0205272 | A1 | 9/2006 | Rodrigues |
| 2006/0276079 | A1 | 12/2006 | Chen |
| 2007/0026734 | A1 | 2/2007 | Bence et al. |
| 2007/0049113 | A1 | 3/2007 | Rodrigues et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0192674 | A1 | 8/2008 | Wang et al. |
| 2008/0225783 | A1 | 9/2008 | Wang et al. |
| 2008/0248689 | A1 | 10/2008 | Montena |
| 2008/0289470 | A1 | 11/2008 | Aston |
| 2009/0017803 | A1 | 1/2009 | Brilhart et al. |
| 2009/0029590 | A1 | 1/2009 | Sykes et al. |
| 2009/0098770 | A1 | 4/2009 | Bence et al. |
| 2009/0163075 | A1 | 6/2009 | Blew et al. |
| 2009/0176396 | A1 | 7/2009 | Mathews |
| 2009/0186521 | A1 | 7/2009 | McMullen et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255720 | A1 | 10/2010 | Radzik et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0027039 | A1 | 2/2011 | Blair |
| 2011/0053413 | A1 | 3/2011 | Mathews |
| 2011/0086543 | A1 | 4/2011 | Alrutz |
| 2011/0111623 | A1 | 5/2011 | Burris et al. |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2011/0250789 | A1 | 10/2011 | Burris et al. |
| 2012/0021642 | A1 | 1/2012 | Zraik |
| 2012/0040537 | A1 | 2/2012 | Burris |
| 2012/0045933 | A1 | 2/2012 | Youtsey |
| 2012/0094530 | A1 | 4/2012 | Montena |
| 2012/0094532 | A1 | 4/2012 | Montena |
| 2012/0122329 | A1 | 5/2012 | Montena |
| 2012/0129387 | A1 | 5/2012 | Holland et al. |
| 2012/0145454 | A1 | 6/2012 | Montena |
| 2012/0171894 | A1 | 7/2012 | Malloy et al. |
| 2012/0196476 | A1 | 8/2012 | Haberek et al. |
| 2012/0202378 | A1 | 8/2012 | Krenceski et al. |
| 2012/0214342 | A1 | 8/2012 | Mathews |
| 2012/0222302 | A1 | 9/2012 | Purdy et al. |
| 2012/0225581 | A1 | 9/2012 | Amidon et al. |
| 2012/0252263 | A1 | 10/2012 | Ehret et al. |
| 2012/0270441 | A1 | 10/2012 | Bence et al. |
| 2013/0034983 | A1 | 2/2013 | Purday et al. |
| 2013/0065433 | A1 | 3/2013 | Burris |
| 2013/0065435 | A1 | 3/2013 | Purdy et al. |
| 2013/0072059 | A1 | 3/2013 | Purday et al. |
| 2013/0102188 | A1 | 4/2013 | Montena |
| 2013/0102189 | A1 | 4/2013 | Montena |
| 2013/0102190 | A1 | 4/2013 | Chastain et al. |
| 2013/0164975 | A1 | 6/2013 | Blake et al. |
| 2013/0171869 | A1 | 7/2013 | Chastain et al. |
| 2013/0171870 | A1 | 7/2013 | Chastain et al. |
| 2013/0183857 | A1 | 7/2013 | Ehret et al. |
| 2013/0337683 | A1 | 12/2013 | Chastain et al. |
| 2014/0051285 | A1 | 2/2014 | Raley et al. |

FOREIGN PATENT DOCUMENTS

| | | | |
|---|---|---|---|
| CN | 201149936.00 | Y | 11/2008 |
| CN | 201149936 | Y | 11/2008 |
| CN | 201149937.00 | Y | 11/2008 |
| CN | 201149937 | Y | 11/2008 |
| CN | 201178228.00 | Y | 1/2009 |
| CN | 201178228 | Y | 1/2009 |
| CN | 201904508.00 | | 7/2011 |
| DE | 47931 | C | 10/1888 |
| DE | 102289 | C | 4/1899 |
| DE | 1117687 | B | 11/1961 |
| DE | 1191880 | | 4/1965 |

(56) References Cited

FOREIGN PATENT DOCUMENTS

| | | | |
|---|---|---|---|
| DE | 1191880.00 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008.00 | A1 | 10/1983 |
| DE | 3211008 | A1 | 10/1983 |
| DE | 9001608.4 | U1 | 4/1990 |
| DE | 9001608.40 | U1 | 4/1990 |
| DE | 4439852.00 | A1 | 5/1996 |
| DE | 4439852 | A1 | 5/1996 |
| DE | 19957518.00 | A1 | 9/2001 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268.00 | A1 | 3/2002 |
| EP | 1191268 | A1 | 3/2002 |
| EP | 1501159.00 | A1 | 1/2005 |
| EP | 1501159 | A1 | 1/2005 |
| EP | 1548898 | | 6/2005 |
| EP | 1548898.00 | A1 | 6/2005 |
| EP | 1701410.00 | A2 | 9/2006 |
| EP | 1701410 | A2 | 9/2006 |
| EP | 2242147 | A1 | 10/2010 |
| FR | 2232846 | A1 | 1/1975 |
| FR | 2234680 | A2 | 1/1975 |
| FR | 2312918 | | 12/1976 |
| FR | 2312918.00 | | 12/1976 |
| FR | 2462798 | A1 | 2/1981 |
| FR | 2494508 | A1 | 5/1982 |
| GB | 589697 | A | 6/1947 |
| GB | 1087228.00 | A | 10/1967 |
| GB | 1087228 | A | 10/1967 |
| GB | 1270846.00 | A | 4/1972 |
| GB | 1270846 | A | 4/1972 |
| GB | 1401373 | A | 7/1975 |
| GB | 2019665 | A | 10/1979 |
| GB | 2079549.00 | A | 1/1982 |
| GB | 2079549 | A | 1/1982 |
| GB | 2252677.00 | A | 8/1992 |
| GB | 2252677 | A | 8/1992 |
| GB | 2264201.00 | A | 8/1993 |
| GB | 2264201 | A | 8/1993 |
| GB | 2331634 | A | 5/1999 |
| GB | 2477479.00 | | 8/2010 |
| JP | 3074864.00 | | 1/2001 |
| JP | 2002-015823 | | 1/2002 |
| JP | 4503793.00 | B9 | 1/2002 |
| JP | 4503793 | B2 | 1/2002 |
| JP | 2002075556.00 | A | 3/2002 |
| JP | 2002075556 | A | 3/2002 |
| JP | 2001102299.00 | | 4/2002 |
| JP | 3280369 | B2 | 5/2002 |
| KR | 2006100622526.00 | B1 | 9/2006 |
| KR | 2006100622526 | B1 | 9/2006 |
| TW | 427044.00 | B | 3/2001 |
| TW | 427044 | B | 3/2001 |
| WO | 8700351 | | 1/1987 |
| WO | 0186756 | A1 | 11/2001 |
| WO | 02069457 | A1 | 9/2002 |
| WO | WO02069457 | A1 | 9/2002 |
| WO | 2004013883 | A2 | 2/2004 |
| WO | 2006081141 | A1 | 8/2006 |
| WO | WO 2010-141880 | A1 | 9/2010 |
| WO | 2010135181 | | 11/2010 |
| WO | 2011128665 | A1 | 10/2011 |
| WO | 2011128666 | A1 | 10/2011 |
| WO | 2012061379 | A2 | 5/2012 |

OTHER PUBLICATIONS

ISR1; PCT/US2011/057939 Date of Mailing: Apr. 30, 2012 International Search Report and Written Opinion. pp. 8.

LIT16; Report and Recommendation, Issued Dec. 5, 2013, *John Mezzalingua Associates, Inc., d/b/a PPC*, v. *Corning Gilbert, Inc.*, United States District Court Northern District of New York, Civil Action No. 5:12-CV-00911-GLS-DEP, 52 pages.

NOA1; Notice of Allowance (Mail Date: Feb. 24, 2012) for U.S. Appl. No. 13/033,127, filed Feb. 23, 2011.

NOA2; Notice of Allowance (Mail Date: Jan. 24, 2013) for U.S. Appl. No. 13/072,350.

NOA3; Notice of Alowance (Date mailed: Jun. 25, 2012) for U.S. Appl. No. 12/633,792, filed Dec. 8, 2009.

NOA4; Notice of Allowance (Mail Date Mar. 20, 2012) for U.S. Appl. No. 13/117, 843, filed May 27, 2011; GAU 2839; Confirmation No. 8447.

OA1; Office Action mail date Mar. 29, 2013 for U.S. Appl. No. 13/712,470.

OA2; Office Action (Mail Date Mar. 6, 2013) for U.S. Appl. No. 13/726,330, filed Dec. 24, 2012.

OA3; Office Action (Mail Date Feb. 20, 2013) for U.S. Appl. No. 13/726,349, filed Dec. 24, 2012.

OA4; Office Action (Mail Date Feb. 20, 2013) for U.S. Appl. No. 13/726,339, filed Dec. 24, 2012.

OA5; Office Action (Mail Date Mar. 11, 2013) for U.S. Appl. No. 13/726,347, filed Dec. 24, 2012.

OA6; Office Action (Mail Date Feb. 20, 2013) for U.S. Appl. No. 13/726,356, filed Dec. 24, 2012.

OA7; Office Action (mail date Apr. 12, 2013) for U.S. Appl. No. 13/712,498, filed Dec. 12, 2012.

OA8; Office Action (mail date Jun. 11, 2013) for U.S. Appl. No. 13/860,964, filed Apr. 11, 2013.

OA9; Office Action (Mail Date: Jun. 2, 2011) for U.S. Appl. No. 13/033,127, filed Feb. 23, 2011.

OA10; Final Office Action (Mail Date: Oct. 25, 2011) for U.S. Appl. No. 13/033,127, filed Feb. 23, 2011.

OA11; Office Action (Mail Date: Oct. 24, 2011) for U.S. Appl. No. 12/633,792, filed on Dec. 8, 2009.

Patent Application No. GB1109575.9 Examination Report Under Section 18(3); Date of Report: Jun. 23, 2011. 3 pp.

Patent No. ZL2010202597847; Evaluation Report of Utility Model Patent; Date of Report: Sep. 2, 2011. 8 pages. (Chinese version with English Translation (10 pages) provided).

PCT/US2010/034870; International Filing Date May 14, 2010. International Search Report and Written Opinion. Date of Mailing: Nov. 30, 2010. 7 pages.

*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,366,481. 96 pages.

*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,469,740. 78 pages.

*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,475,205. 236 pages.

*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,480,430. 189 pages.

*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,480,431. 73 pages.

*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,485,845. 73 pages.

*PPC Broadband, Inc., d/b/a PPC*, v. *PCT International, Inc.*, USDC, Northern District of New York, Case No. 5:13-cv-0135-GTS-DEP, Defendant PCT International, Inc.'s Disclosure of Pre-

(56) References Cited

OTHER PUBLICATIONS liminary Non-Infringement, Invalidity, and Unenforceability Contentions Filed Jul. 29, 2013. 86 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.
*PPC Broadband, Inc., d/b/a PPC*, v. *PCT International*, Inc., USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-04. 122 pages.
RES1; Response dated Jun. 24, 2011 to Office Action (Mail Date: Jun. 2, 2011) for U.S. Appl. No. 13/033,127, filed Feb. 23, 2011.
TECHDOC1; Philips, NXP, "PDCCH message information content for persistent scheduling," R1-081506, Agenda Item: 6.1.3, 3GPP TSG RAN WG1 Meeting #52bis, Shenzhen, China, Mar. 31-Apr. 4, 2008, 3 pages.
TECHDOC2; NTT DoCoMo, Inc. "UL semi-persistent resource deactivation," R2-082483 (resubmission of R2-081859), Agenda Item: 5.1.1.8, 3GPP TSG RAN WG2 #62, Kansas City, MO, USA, May 5-9, 2008, 2 pages.
TECHDOC3; Panasonic, "Configuration for semi-persistent scheduling," R2-081575, Agenda Item: 5.1.1.8, 3GPP TSG RAN WG2 #61bis, Shenzhen, China, Mar. 31-Apr. 4, 2008, 4 pages.
TECHDOC4; Panasonic, "Remaining issues on Persistent scheduling," R2-083311, derived from R2-082228 and R2-082229, Agenda Item: 6.1.1.8, 3GPP TSG RAN WG2 #62bis, Warsaw, Poland, Jun. 30-Jul. 4, 2008, 4 pages.
TECHDOC7; Nokia Corporation, Nokia Siemens Networks, "Persistent Scheduling for DL," R2-080683 (RS-080018), 3GPP TSG-RAN WG2 Meeting #61, Agenda Item: 5.1.1.8, Sorrento, Italy, Feb. 11-15, 2008, 6 pages.
TECHDOC8; Panasonic, "SPS activation and release," R1-084233, 3GPP TSG-RAN WG1 Meeting #55, Prague, Czech Republic, Nov. 10-14, 2008, 6 pages.
TECHDOC9; PCT International, Inc., Compression Connectors Installation Guide, Aug. 3, 2009.
TECHDOC10; PPC Product Guide, 2008.
TechDoc11; NTT DoCoMo, Alcatel, Cingular Wireless, CMCC, Ericsson, Fujitsu, Huawei, LG Electronics, Lucent Technologies, Mitsubishi Electric, Motorola, NEC, Nokia, Nortel Networks, Orange, Panasonic, Philips, Qualcomm Europe, Samsung, Sharp Siemens, Telecom Italia, Telefonica, TeliaSonera, T-Mobile, Vodafone, "Proposed Study Item on Evolved UTRA and UTRAN," RP-040461, Agenda Item: 8.12, TSG-RAN Meeting #26, Athens, Greece, Dec. 8-10, 2004, 5 pages.
TECHSPEC1A; "3rd Generation Partnership Project; Technical Specification Group Radio Access Network; Requirements for Evolved UTRA (E-UTRA) and Evolved UTRAN (E-UTRAN) (Release 7)," Technical Report, 3GPP TR 125.913 V7.3.0, Mar. 2006, 18 pages.
TECHSPEC2A; "3rd Generation Partnership Project; Technical Specification Group Radio Access Network; Evolved Universal Terrestrial Radio Access (E-UTRA) and Evolved Universal Terrestrial Radio Access Network (E-UTRAN); Overall description; Stage 2 (Release 8)," Technical Specification, 3GPP TS 36.300 V8.5.0, May 2008, 134 pages.
TECHSPEC3A; "3rd Generation Partnership Project; Technical Specification Group Radio Access Network; Evolved Universal Terrestrial Radio Access (E-UTRA) Medium Access Control (MAC) protocol specification (Release 8)," Technical Specification, 3GPP TS 36.321 V8.2.0, May 2008, 32 pages.
TECHSPEC4A; "3rd Generation Partnership Project; Technical Specification Group Radio Access Netowrk; Evolved Universal Terrestrial Radio Access (E-UTRA); Physical layer procedures (Release 8)," Technical Specification, 3GPP TS 36.213 V8.4.0, Sep. 2008, 60 pages.
EESR1; Extended European Search Report; European Application No. 12763440.0; Date of Mailing: Jul. 22, 2014; 9 pages.
ARRIS1; Digicon AVL Connector. Arris Group Inc. [online]. 3 pages. [retrieved on Apr. 22, 2010]. Retrieved from the Internet:<URL: http://www.arrisi.com/special/digiconAVLasp>.
TECHSPEC5A; Society of Cable Telecommunications Engineers, Engineering Committee, Interface Practices Subcommittee; American National Standard; ANSI/SCTE Jan. 2006; "Specification for "F" Port, Female, Outdoor". Published Jan. 2006. 9 pages.
TECHSPEC6A; Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.
LIT13; *PPC Broadband, Inc., d/b/a PPC*, v. *PCT International, Inc.*, USDC, Northern District of New York, Case No. 5:13-cv-0135-GTS-DEP, Defendant PCT International, Inc.'s Disclosure of Preliminary Non-Infringement, Invalidity, and Unenforceability Contentions Filed Jul. 29, 2013. 86 pages.
LIT14; *PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.
LIT14B; *PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.
LIT14C; *PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-C4. 122 pages.
LIT15; *PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U. S. Pat. No. 8,366,481. 96 pages.
LIT15B; *PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,469,740. 78 pages.
LIT15C; *PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,475,205. 236 pages.
LIT15D; *PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,480,430. 189 pages.
LIT15E;*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U. S. Pat. No. 8,480,431. 73 pages.
LIT15F; *PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U. S. Pat. No. 8,485,845. 73 pages.
European Patent Office, Extended European Search Report from EP Appl. No. 15179665.3-1801 dated Nov. 25, 2015 (total 12 pages).
Corning Optical Communications RF LLC, U.S. Appl. No. 13/084,099, filed Apr. 11, 2011, US Patent Application and File History.

(56) References Cited

OTHER PUBLICATIONS

Petition for Inter Partes Review Case IPR2016-01570—U.S. Pat. No. 8,366,481 (Claims 1, 3-7 and 14-16) under 35 USC §§ 311-319 and 37 CFR § 42.100, filed Aug. 9, 2016 (total 83 pages).
Petition for Inter Partes Review Case IPR2016-01572—U.S. Pat. No. 8,366,481 (Claims 1, 3-7 and 14-16) under 35 USC §§ 311-319 and 37 CFR § 42.100, filed Aug. 9, 2016 (total 79 pages).

CONTINUITY MAINTAINING BIASING MEMBER

PRIORITY CLAIM

This continuation application claims the priority benefit of U.S. Non-Provisional patent application Ser. No. 13/726,330 filed Dec. 24, 2012, which claims the priority benefit of U.S. Non-Provisional patent application Ser. No. 13/075,406 filed Mar. 30, 2011, now issued as U.S. Pat. No. 8,366,481 and entitled CONTINUITY MAINTAINING BIASING MEMBER.

CROSS REFERENCE TO RELATED APPLICATIONS

This application is related to the following commonly-owned, co-pending patent applications: (a) U.S. patent application Ser. No. 14/134,892, filed on Dec. 19, 2013; (b) U.S. patent application Ser. No. 14/104,463, filed on Dec. 12, 2013; (c) U.S. patent application Ser. No. 14/104,363, filed on Dec. 12, 2013; (d) U.S. patent application Ser. No. 13/971,147, filed on Aug. 20, 2013; (e) U.S. patent application Ser. No. 14/092,103, filed on Nov. 27, 2013; (f) U.S. patent application Ser. No. 14/092,003, filed on Nov. 27, 2013; (g) U.S. patent application Ser. No. 14/091,875, filed on Nov. 27, 2013; (h) U.S. patent application Ser. No. 13/971,147, filed on Aug. 20, 2013; (i) U.S. patent application Ser. No. 13/758,586, filed on Feb. 4, 2013; and (j) U.S. patent application Ser. No. 13/712,470, filed on Dec. 12, 2012.

FIELD OF TECHNOLOGY

The following relates to connectors used in coaxial cable communication applications, and more specifically to embodiments of a connector having a biasing member for maintaining continuity through a connector.

BACKGROUND

Connectors for coaxial cables are typically connected onto complementary interface ports to electrically integrate coaxial cables to various electronic devices. Maintaining continuity through a coaxial cable connector typically involves the continuous contact of conductive connector components which can prevent radio frequency (RF) leakage and ensure a stable ground connection. In some instances, the coaxial cable connectors are present outdoors, exposed to weather and other numerous environmental elements. Weathering and various environmental elements can work to create interference problems when metallic conductive connector components corrode, rust, deteriorate or become galvanically incompatible, thereby resulting in intermittent contact, poor electromagnetic shielding, and degradation of the signal quality. Moreover, some metallic connector components can permanently deform under the torque requirements of the connector mating with an interface port. The permanent deformation of a metallic connector component results in intermittent contact between the conductive components of the connector and a loss of continuity through the connector.

Thus, a need exists for an apparatus and method for ensuring continuous contact between conductive components of a connector.

SUMMARY

A first general aspect relates to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a biasing member disposed within a cavity formed between the first end of the coupling element and the connector body to bias the coupling element against the post.

A second general aspect relates to a coaxial cable connector comprising a post having a first end, a second end, and a flange proximate the second end, wherein the post is configured to receive a center conductor surrounded by a dielectric of a coaxial cable, a coupling element attached to the post, the coupling element having a first end and a second end, and a connector body having a biasing element, wherein the biasing element biases the coupling element against the post.

A third general aspect relates to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a means for biasing the coupling element against the post, wherein the means does not hinder rotational movement of the coupling element.

A fourth general aspect relates to a method of facilitating continuity through a coaxial cable connector, comprising providing a post having a first end, a second end, and a flange proximate the second end, wherein the post is configured to receive a center conductor surrounded by a dielectric of a coaxial cable, a connector body attached to the post, and a coupling element attached to the post, the coupling element having a first end and a second end, and disposing a biasing member within a cavity formed between the first end of the coupling element and the connector body to bias the coupling element against the post.

A fifth general aspect relates to a method of facilitating continuity through a coaxial cable connector, comprising providing a post having a first end, a second end, and a flange proximate the second end, wherein the post is configured to receive a center conductor surrounded by a dielectric of a coaxial cable, a coupling element attached to the post, the coupling element having a first end and a second end, and a connector body having a first end, a second end, and an annular recess proximate the second end of the connector body, extending the annular recess a radial distance to engage the coupling element, wherein the engagement between the extended annular recess and the coupling element biases the coupling element against the post.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1A:
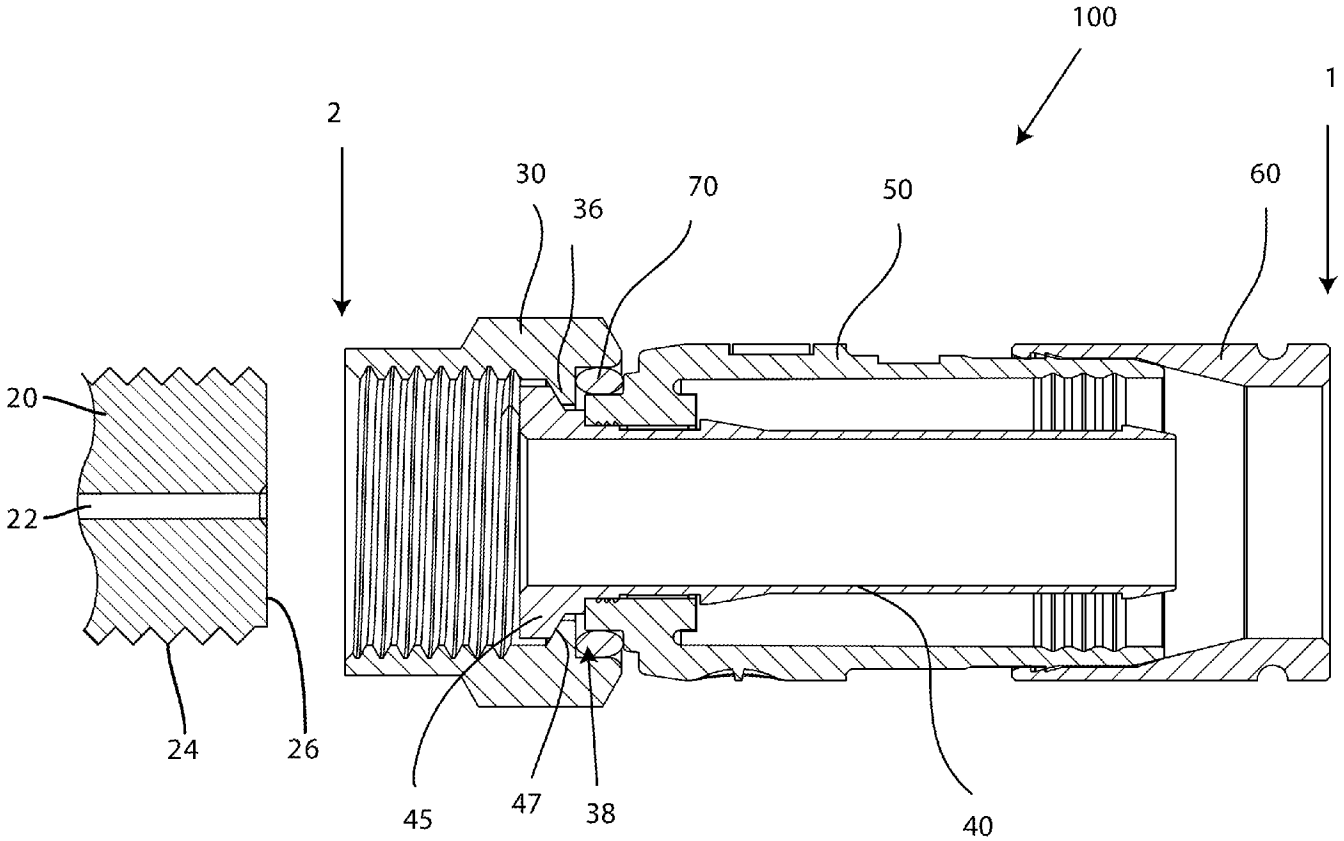
FIG. 1A depicts a cross-sectional view of a first embodiment of a coaxial cable connector.
Figure 1B:
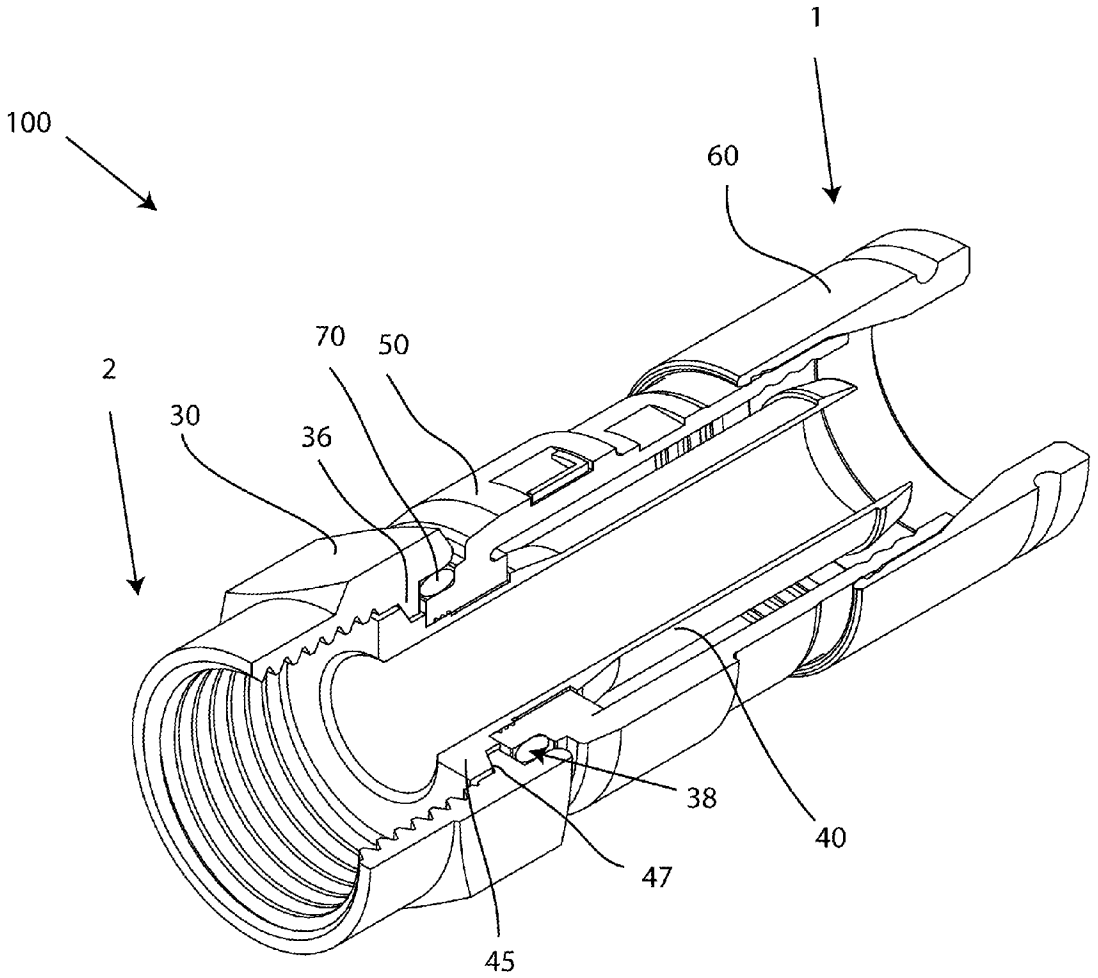
FIG. 1B depicts a perspective cut-away view of the first embodiment of a coaxial cable connector.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be an F connector, or similar coaxial cable connector. Furthermore, the connector 100 includes a post 40 configured for receiving a prepared portion of a coaxial cable 10.

Figure 2:
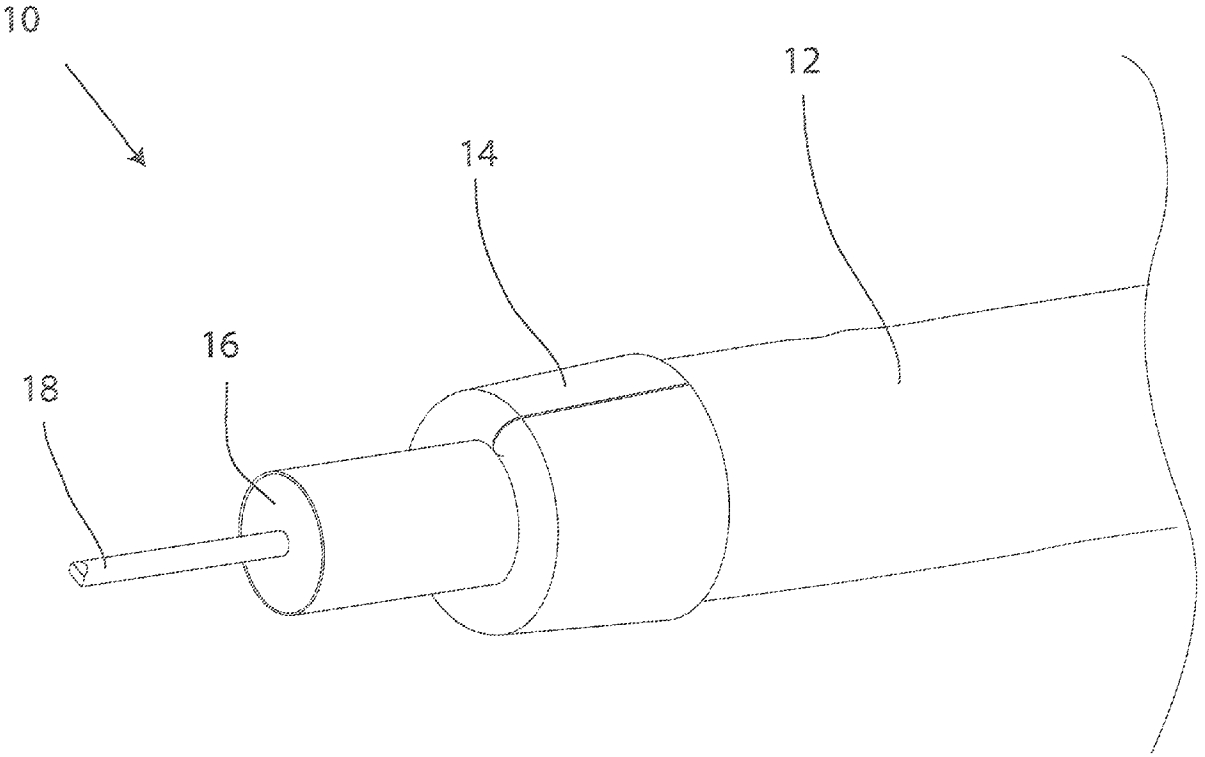
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12*a*, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to preventingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Furthermore, environmental elements that contact conductive components, including metallic components, of a coaxial connector may be important to the longevity and efficiency of the coaxial cable connector (i.e. preventing RF leakage and ensuring stable continuity through the connector 100). Environmental elements may include any environmental pollutant, any contaminant, chemical compound, rainwater, moisture, condensation, stormwater, polychlorinated biphenyl's (PCBs), contaminated soil from runoff, pesticides, herbicides, and the like. Environmental elements, such as water or moisture, may corrode, rust, degrade, etc. connector components exposed to the environmental elements. Thus, metallic conductive O-rings utilized by a coaxial cable connector that may be disposed in a position of exposure to environmental elements may be insufficient over time due to the corrosion, rusting, and overall degradation of the metallic O-ring.

Referring back to FIG. 1, the connector 100 may mate with a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Referring further to FIG. 1, embodiments of a connector 100 may include a post 40, a coupling element 30, a connector body 50, a fastener member 60, and a biasing member 70. Embodiments of connector 100 may also include a post 40 having a first end 41, a second end 42, and a flange 45 proximate the second end 42, wherein the post 40 is configured to receive a center conductor 18 surrounded by a dielectric 16 of a coaxial cable 10, a connector body 50 attached to the post 40, a coupling element 30 attached to the post 40, the coupling element 30 having a first end 31 and a second end 32, and a biasing member 70 disposed within a cavity 38 formed between the first end 31 of the coupling element 30 and the connector body 50 to bias the coupling element 30 against the post 40.

Figure 3:
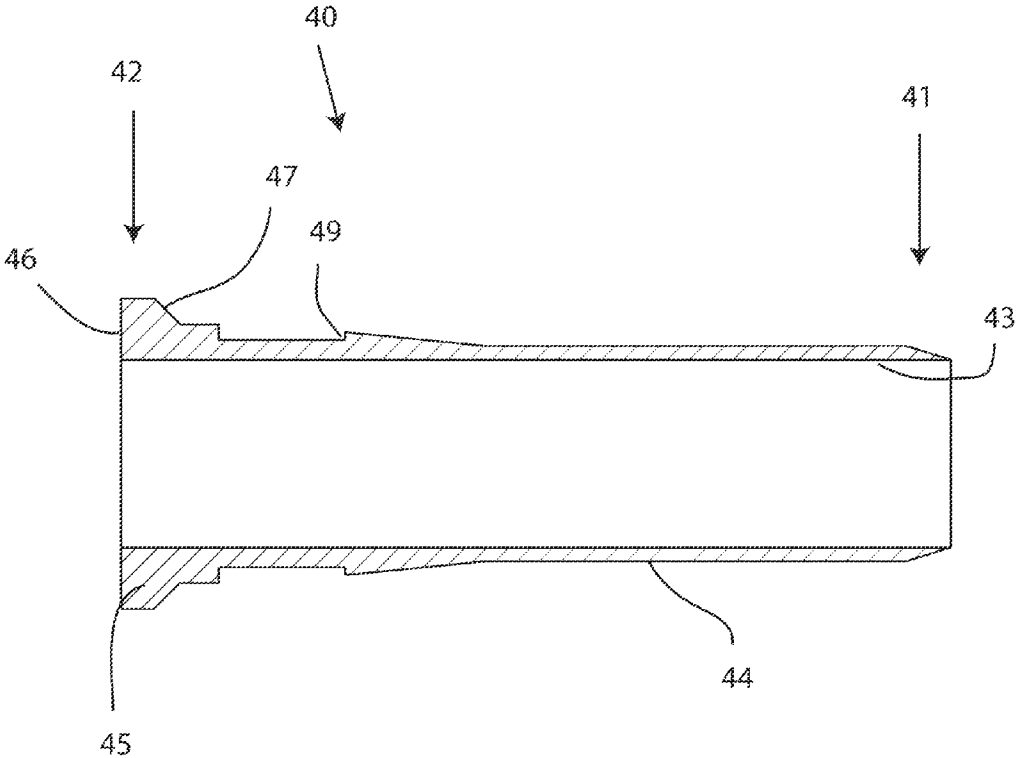
FIG. 3 depicts a cross-sectional view of an embodiment of a post.

Embodiments of connector 100 may include a post 40, as further shown in FIG. 3. The post 40 comprises a first end 41, a second end 42, an inner surface 43, and an outer surface 44. Furthermore, the post 40 may include a flange 45, such as an externally extending annular protrusion, located proximate or otherwise near the second end 42 of the post 40. The flange 45 may include an outer tapered surface 47 facing the first end 41 of the post 40 (i.e. tapers inward toward the first end 41 from a larger outer diameter proximate or otherwise near the second end 42 to a smaller outer diameter. The outer tapered surface 47 of the flange 45 may correspond to a tapered surface of the lip 36 of the coupling element 30. Further still, an embodiment of the post 40 may include a surface feature 49 such as a lip or protrusion that may engage a portion of a connector body 50 to secure axial movement of the post 40 relative to the connector body 50. However, the post may not include such a surface feature 49, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the first end 41 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 4:
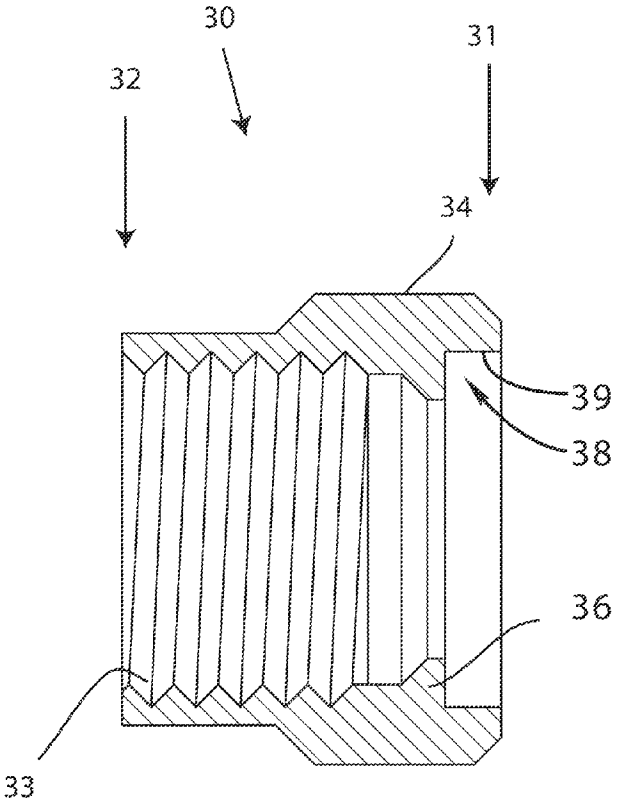
FIG. 4 depicts a cross-sectional view of an embodiment of a coupling element.

With continued reference to FIG. 1, and further reference to FIG. 4, embodiments of connector 100 may include a coupling element 30. The coupling element 30 may be a nut, a threaded nut, port coupling element, rotatable port coupling element, and the like. The coupling element 30 may include a first end 31, second end 32, an inner surface 33, and an outer surface 34. The inner surface 33 of the coupling element 30 may be a threaded configuration, the threads having a pitch and depth corresponding to a threaded port, such as interface port 20. In other embodiments, the inner surface 33 of the coupling element 30 may not include threads, and may be axially inserted over an interface port, such as port 20. The coupling element 30 may be rotatably secured to the post 40 to allow for rotational movement about the post 40. The coupling element 30 may comprise an internal lip 36 located proximate the first end 31 and configured to hinder axial movement of the post 40. Furthermore, the coupling element 30 may comprise a cavity 38 extending axially from the edge of first end 31 and partial defined and bounded by the internal lip 36. The cavity 38 may also be partially defined and bounded by an outer internal wall 39. The coupling element 30 may be formed of conductive materials facilitating grounding through the coupling element 30, or threaded nut. Accordingly the coupling element 30 may be configured to extend an electromagnetic buffer by electrically contacting conductive surfaces of an interface port 20 when a coaxial cable connector, such as connector 100, is advanced onto the port 20. In addition, the coupling element 30 may be formed of non-conductive material and function only to physically secure and advance a connector 100 onto an interface port 20. Moreover, the coupling element 30 may be formed of both conductive and non-conductive materials. For example the internal lip 36 may be formed of a polymer, while the remainder of the coupling element 30 may be comprised of a metal or other conductive material. In addition, the coupling element 30 may be formed of metals or polymers or other materials that would facilitate a rigidly formed body. Manufacture of the coupling element 30 may include casting, extruding, cutting, turning, tapping, drilling, injection molding, blow molding, or other fabrication methods that may provide efficient production of the component. Those in the art should appreciate the various of embodiments of the nut 30 may also comprise a coupler member, or coupling element, having no threads, but being dimensioned for operable connection to a corresponding interface port, such as interface port 20.

Figure 5:
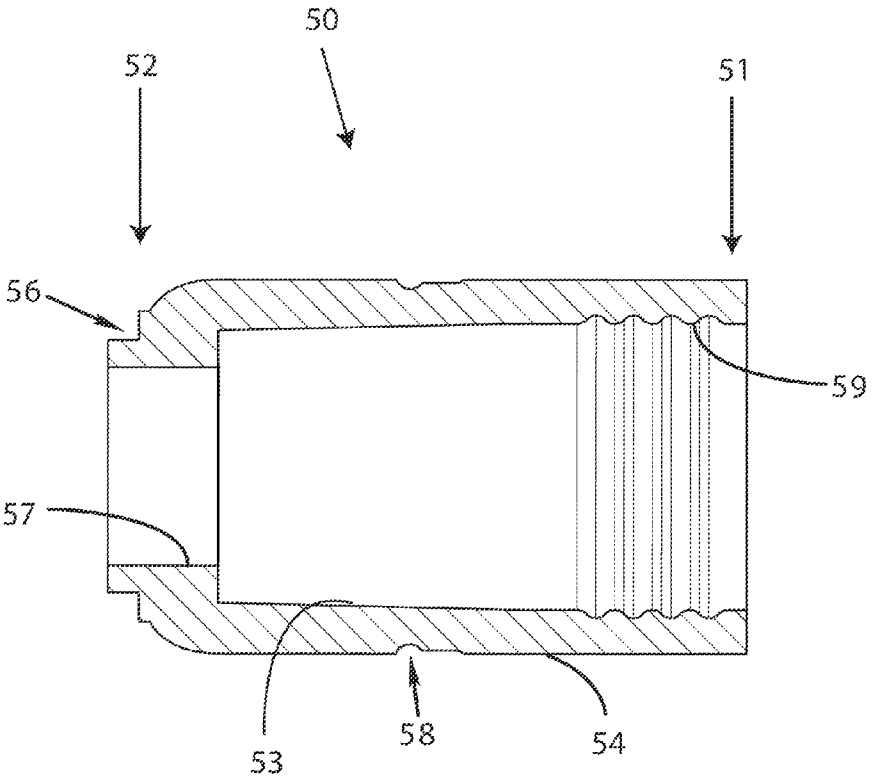
FIG. 5 depicts a cross-sectional view of a first embodiment of a connector body.

Referring still to FIG. 1, and additionally to FIG. 5, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the second end 52 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the second end 52 of the connector body 50. Furthermore, the connector body 50 may include a semi-rigid, yet compliant outer surface 54, wherein the outer surface 54 may be configured to form an annular seal when the first end 51 is deformably compressed against a received coaxial cable 10 by operation of a fastener member 60. The connector body 50 may include an external annular detent 58 located along the outer surface 54 of the connector body 50. Further still, the connector body 50 may include internal surface features 59, such as annular serrations formed near or proximate the internal surface of the first end 51 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

Figure 6:
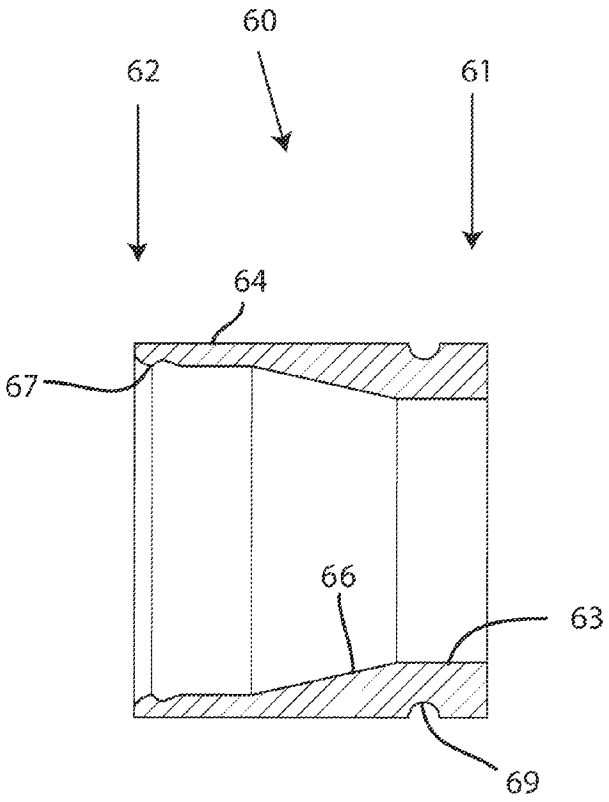
FIG. 6 depicts a cross-sectional view of an embodiment of a fastener member.

With further reference to FIG. 1 and FIG. 6, embodiments of a coaxial cable connector 100 may include a fastener member 60. The fastener member 60 may have a first end 61, second end 62, inner surface 63, and outer surface 64. In addition, the fastener member 60 may include an internal annular protrusion 67 located proximate the second end 62 of the fastener member 60 and configured to mate and achieve purchase with the annular detent 58 on the outer surface 54 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the first end 61 of the fastener member 60 and a second opening or inner bore having a larger, second inner diameter positioned proximate or otherwise near the second end 62 of the fastener member 60. The ramped surface 66 may act to deformably compress the outer surface 54 of the connector body 50 when the fastener member 60 is operated to secure a coaxial cable 10. For example, the narrowing geometry will compress squeeze against the cable, when the fastener member 60 is compressed into a tight and secured position on the connector body 50. Additionally, the fastener member 60 may comprise an exterior surface feature 69 positioned proximate with or close to the first end 61 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The second end 62 of the fastener member 60 may extend an axial distance so that, when the fastener member 60 is compressed into sealing position on the coaxial cable 100, the fastener member 60 touches or resides substantially proximate significantly close to the coupling element 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Referring back to FIG. 1, embodiments of a coaxial cable connector 100 can include a biasing member 70. The biasing member 70 may be formed of a non-metallic material to avoid rust, corrosion, deterioration, and the like, caused by environmental elements, such as water. Additional materials the biasing member 70 may be formed of may include, but are not limited to, polymers, plastics, elastomers, elastomeric mixtures, composite materials, rubber, and/or the like and/or any operable combination thereof. The biasing member 70 may be a resilient, rigid, semi-rigid, flexible, or elastic member, component, element, and the like. The resilient nature of the biasing member 70 may help avoid permanent deformation while under the torque requirements when a connector 100 is advanced onto an interface port 20.

Moreover, the biasing member 70 may facilitate constant contact between the coupling element 30 and the post 40. For instance, the biasing member 70 may bias, provide, force, ensure, deliver, etc. the contact between the coupling element 30 and the post 40. The constant contact between the coupling element 30 and the post 40 promotes continuity through the connector 100, reduces/eliminates RF leakage, and ensures a stable ground through the connection of a connector 100 to an interface port 20 in the event the connector 100 is not fully tightened onto the port 20. To establish and maintain solid, constant contact between the coupling element 30 and the post 40, the biasing member 70 may be disposed behind the coupling element 30, proximate or otherwise near the second end 52 of the connector. In other words, the biasing member 70 may be disposed within the cavity 38 formed between the coupling element 30 and the annular recess 56 of the connector body 50. The biasing member 70 can provide a biasing force against the coupling element 30, which may axially displace the coupling element 30 into constant direct contact with the post 40. In particular, the disposition of a biasing member 70 in annular cavity 38 proximate the second end 52 of the connector body 50 may axially displace the coupling element 30 towards the post 40, wherein the lip 36 of the coupling element 30 directly contacts the outer tapered surface 47 of the flange 45 of the post 40. The location and structure of the biasing member 70 may promote continuity between the post 40 and the coupling element 30, but does not impede the rotational movement of the coupling element 30 (e.g. rotational movement about the post 40). The biasing member 70 may also create a barrier against environmental elements, thereby preventing environmental elements from entering the connector 100. Those skilled in the art would appreciate that the biasing member 70 may be fabricated by extruding, coating, molding, injecting, cutting, turning, elastomeric batch processing, vulcanizing, mixing, stamping, casting, and/or the like and/or any combination thereof in order to provide efficient production of the component.

Embodiments of biasing member 70 may include an annular or semi-annular resilient member or component configured to physically and electrically couple the post 40 and the coupling element 30. One embodiment of the biasing member 70 may be a substantially circinate torus or toroid structure, or other ring-like structure having a diameter (or cross-section area) large enough that when disposed within annular cavity 38 proximate the annular recess 56 of the connector body 50, the coupling element 30 is axially displaced against the post 40 and/or biased against the post 40. Moreover, embodiments of the biasing member 70 may be an O-ring configured to cooperate with the annular recess 56 proximate the second end 52 of connector body 50 and the outer internal wall 39 and lip 36 forming cavity 38 such that the biasing member 70 may make contact with and/or bias against the annular recess 56 (or other portions) of connector body 50 and outer internal wall 39 and lip 36 of coupling element 30. The biasing between the outer internal wall 39 and lip 36 of the coupling element 30 and the annular recess 56, and surrounding portions, of the connector body 50 can drive and/or bias the coupling element 30 in a substantially axial or axial direction towards the second end 2 of the connector 100 to make solid and constant contact with the post 40. For instance, the biasing member 70 should be sized and dimensioned large enough (e.g. oversized O-ring) such that when disposed in cavity 38, the biasing member 70 exerts enough force against both the coupling element 30 and the connector body 50 to axial displace the coupling element 30 a distance towards the post 40. Thus, the biasing member 70 may facilitate grounding of the connector 100, and attached coaxial cable 10 (shown in FIG. 2), by extending the electrical connection between the post 40 and the coupling element 30. Because the biasing member 70 may not be metallic and/or conductive, it may resist degradation, rust, corrosion, etc., to environmental elements when the connector 100 is exposed to such environmental elements. Furthermore, the resiliency of the biasing member 70 may deform under torque requirements, as opposed to permanently deforming in a manner similar to metallic or rigid components under similar torque requirements. Axial displacement of the connector body 50 may also occur, but the surface 49 of the post 40 may prevent axial displacement of the connector body 50, or friction fitting between the connector body 50 and the post 40 may prevent axial displacement of the connector body 50.

Figure 7:
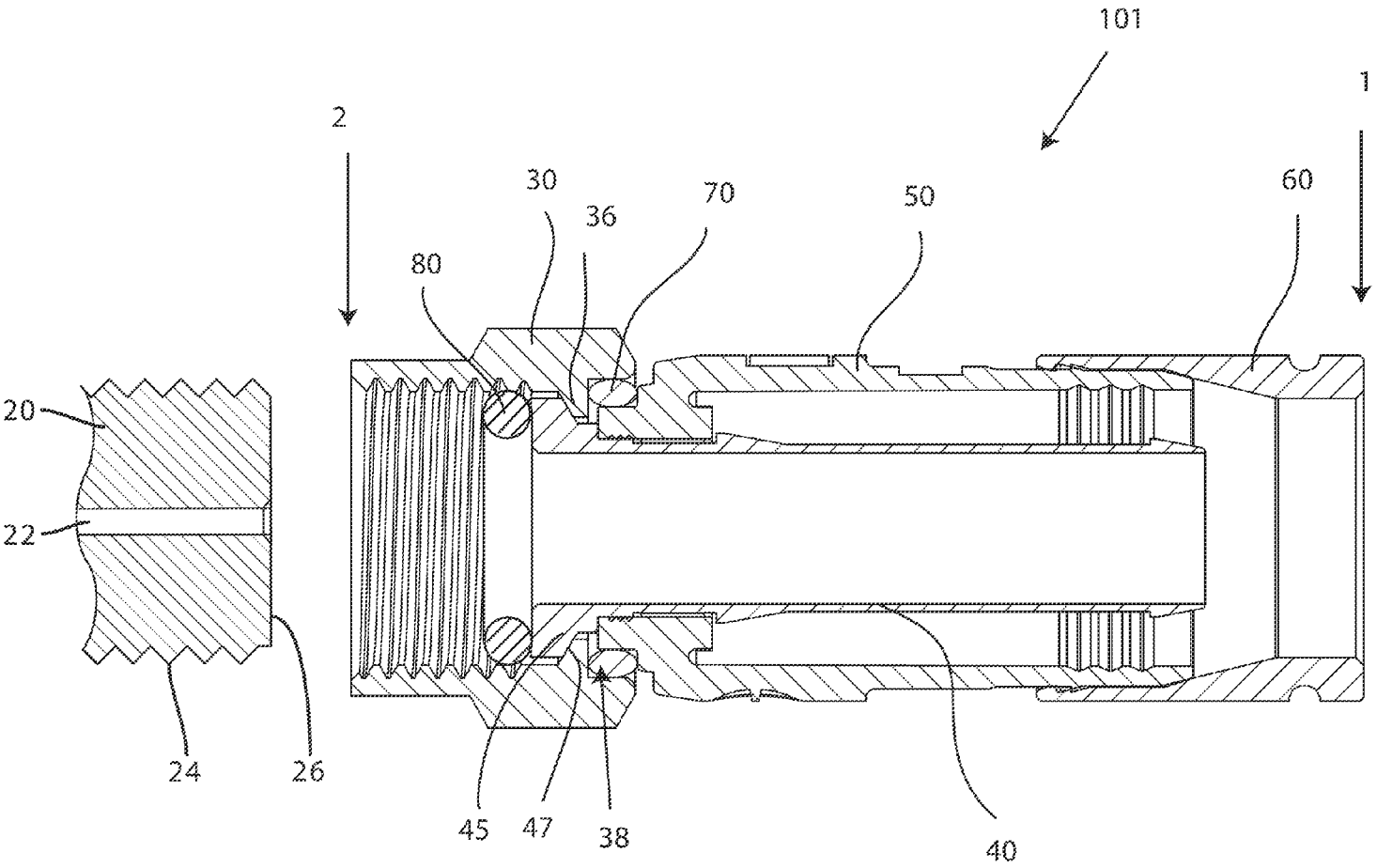
FIG. 7 depicts a cross-sectional view of a second embodiment of a coaxial cable connector.

With continued reference to the drawings, FIG. 7 depicts an embodiment of connector 101. Connector 101 may include post 40, coupling element 30, connector body 50, fastener member 60, biasing member 70, but may also include a mating edge conductive member 80 formed of a conductive material. Such materials may include, but are not limited to conductive polymers, conductive plastics, conductive elastomers, conductive elastomeric mixtures, composite materials having conductive properties, soft metals, conductive rubber, and/or the like and/or any operable combination thereof. The mating edge conductive member 80 may comprise a substantially circinate torus or toroid structure, and may be disposed within the internal portion of coupling element 30 such that the mating edge conductive member 80 may make contact with and/or reside continuous with a mating edge 46 of a post 40 when connector 101 is operably configured (e.g. assembled for communication with interface port 20). For example, one embodiment of the mating edge conductive member 80 may be an O-ring. The mating edge conductive member 80 may facilitate an annular seal between the coupling element 30 and post 40 thereby providing a physical barrier to unwanted ingress of moisture and/or other environmental contaminates. Moreover, the mating edge conductive member 80 may facilitate electrical coupling of the post 40 and coupling element 30 by extending therebetween an unbroken electrical circuit. In addition, the mating edge conductive member 80 may facilitate grounding of the connector 100, and attached coaxial cable (shown in FIG. 2), by extending the electrical connection between the post 40 and the coupling element 30. Furthermore, the mating edge conductive member 80 may effectuate a buffer preventing ingress of electromagnetic noise between the coupling element 30 and the post 40. The mating edge conductive member or O-ring 80 may be provided to users in an assembled position proximate the second end 42 of post 40, or users may themselves insert the mating edge conductive O-ring 80 into position prior to installation on an interface port 20. Those skilled in the art would appreciate that the mating edge conductive member 80 may be fabricated by extruding, coating, molding, injecting, cutting, turning, elastomeric batch processing, vulcanizing, mixing, stamping, casting, and/or the like and/or any combination thereof in order to provide efficient production of the component.

Figure 8A:
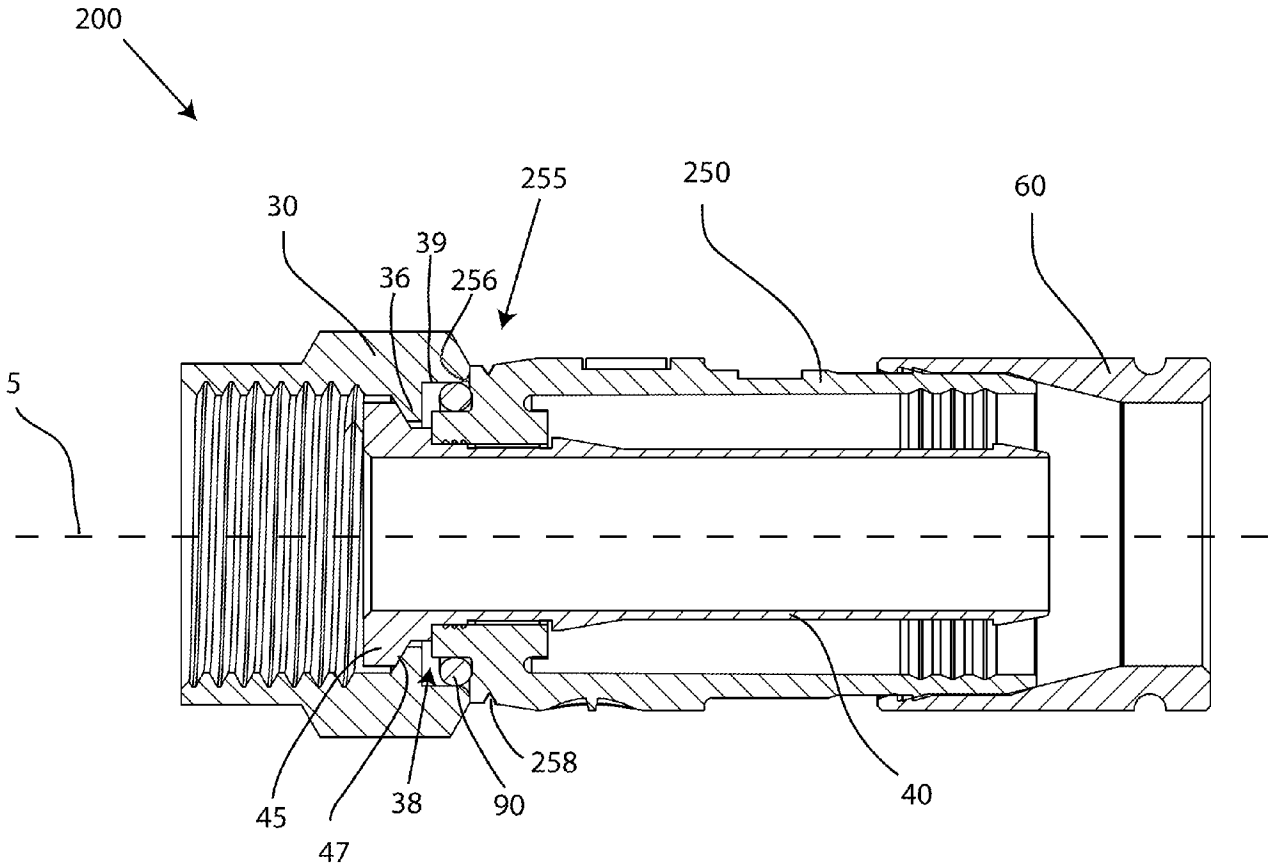
FIG. 8A depicts a cross-sectional view of a third embodiment of a coaxial cable connector.
Figure 8B:
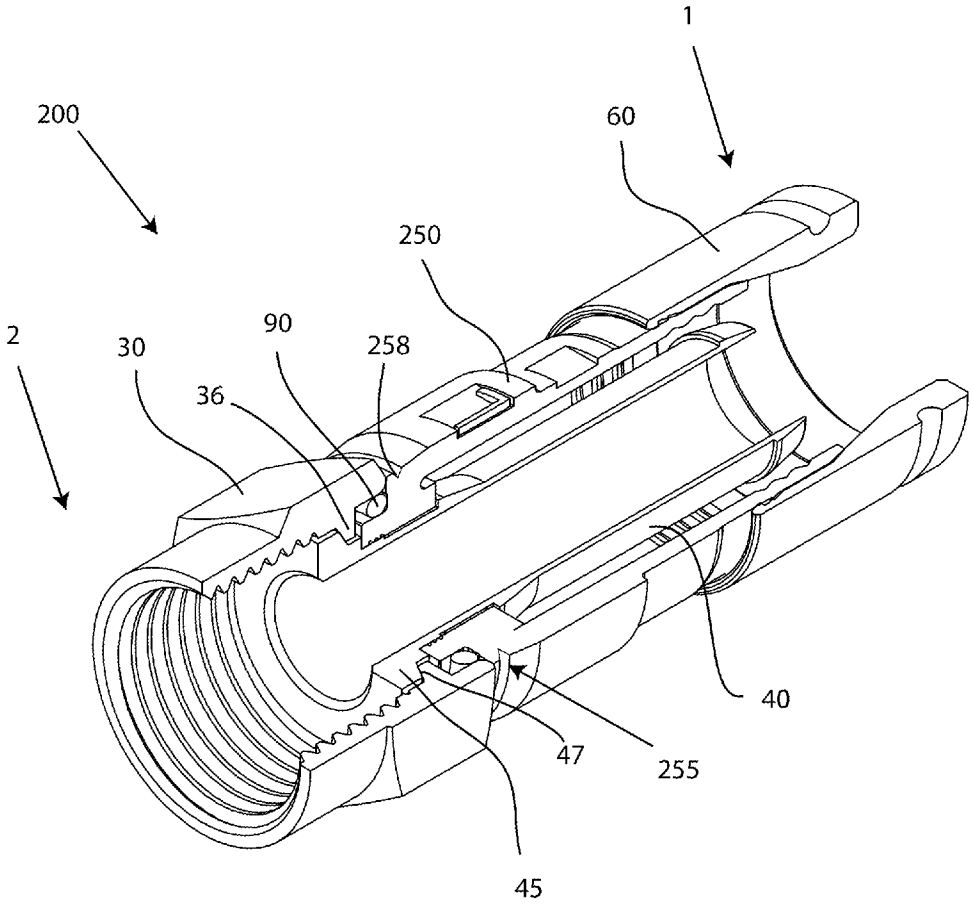
FIG. 8B depicts a perspective cut-away of the third embodiment of a coaxial cable connector.

Referring now to FIGS. 8A and 8B, an embodiment of connector 200 is described. Embodiments of connector 200 may include a post 40, a coupling element 30, a fastener member 60, a connector body 250 having biasing element 255, and a connector body member 90. Embodiments of the post 40, coupling element 30, and fastener member 60 described in association with connector 200 may share the same structural and functional aspects as described above in association with connectors 100, 101. Embodiments of connector 200 may also include a post 40 having a first end 41, a second end 42, and a flange 45 proximate the second end 42, wherein the post 40 is configured to receive a center conductor surrounded 18 by a dielectric 16 of a coaxial cable 10, a coupling element 30 attached to the post 40, the coupling element 30 having a first end 31 and a second end 32, and a connector body 250 having biasing element 255, wherein the engagement biasing element 255 biases the coupling element 30 against the post 40.

Figure 9:
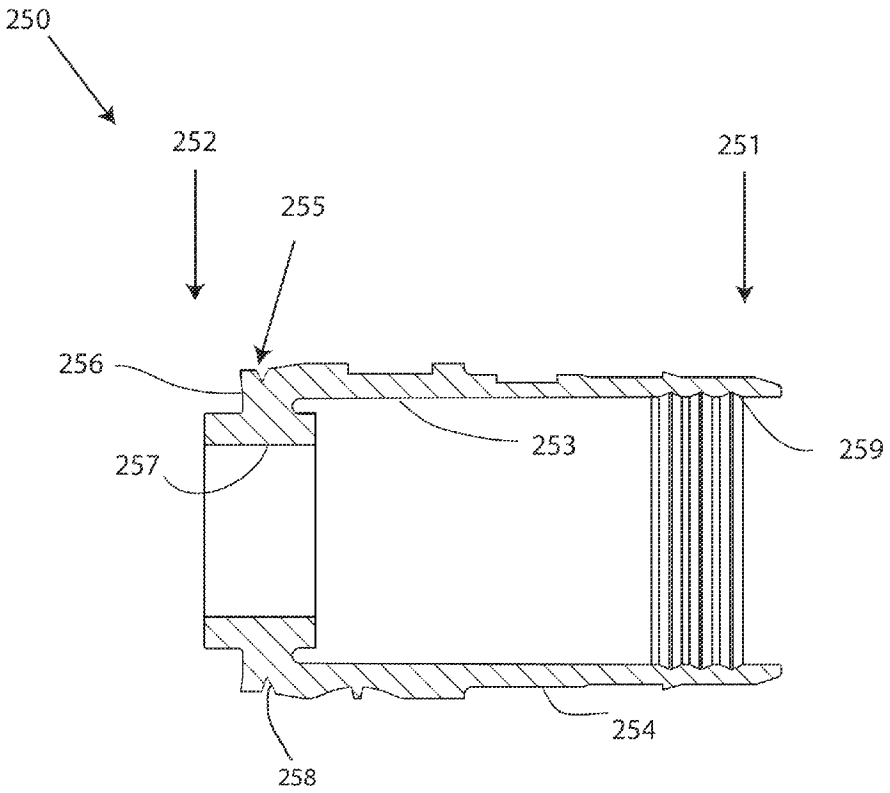
FIG. 9 depicts a cross-sectional view of a second embodiment of a connector body.

With reference now to FIG. 9, and continued reference to FIGS. 8A and 8B, embodiments of connector 200 may include a connector body 250 having a biasing element 255. The connector body 250 may include a first end 251, a second end 252, an inner surface 253, and an outer surface 254. Moreover, the connector body 250 may include a post mounting portion 257 proximate or otherwise near the second end 252 of the body 250; the post mounting portion 257 configured to securely locate the body 250 relative to a portion of the outer surface 44 of post 40, so that the connector body 250 is axially secured with respect to the post 40, in a manner that prevents the two components from moving with respect to each other in a direction parallel to the axis of the connector 200. In addition, the connector body 250 may include an extended, resilient outer annular surface 256 located proximate or near the second end 252 of the connector body 250. The extended, resilient annular surface 256 may extend a radial distance with respect to a general axis 5 of the connector 200 to facilitate biasing engagement with the coupling element 30. For instance, the extended annular surface 256 may radially extend past the internal wall 39 of the coupling element 30. In one embodiment, the extended, resilient annular surface 256 may be a resilient extension of annular recess 56 of connector body 50. In other embodiments, the extended, resilient annular surface 256, or shoulder, may function as a biasing element 255 proximate the second end 252. The biasing element 255 may be structurally integral with the connector body 250, such that the biasing element 255 is a portion of the connector body 250. In other embodiments, the biasing element 255 may be a separate component fitted or configured to be coupled with (e.g. adhered, snapped on, interference fit, and the like) an existing connector body, such as connector body 50. Moreover, the biasing element 255 of connector body 250 may be defined as a portion of the connector body 255, proximate the second end 252, that extends radially and potentially axially (slightly) from the body to bias the coupling element 30, proximate the first end 31, into contact with the post 40. The biasing element 255 may include a notch 258 to permit the necessary deflection to provide a biasing force to effectuate constant physical contact between the lip 36 of the coupling element 30 and the outer tapered surface 47 of the flange 45 of the post 40. The notch 258 may be a notch, groove, channel, or similar annular void that results in an annular portion of the connector body 50 that is removed to permit deflection in an axial direction with respect to the general axis 5 of connector 200.

Accordingly, a portion of the extended, resilient annular surface 256, or the biasing element 255, may engage the coupling element 30 to bias the coupling element 30 into contact with the post 40. Contact between the coupling element 30 and the post 40 may promote continuity through the connector 200, reduce/eliminate RF leakage, and ensure a stable ground through the connection of the connector 200 to an interface port 20 in the event the connector 200 is not fully tightened onto the port 20. In most embodiments, the extended annular surface 256 or the biasing element 255 of the connector body 250 may provide a constant biasing force behind the coupling element 30. The biasing force provided by the extended annular surface 256, or biasing element 255, behind the coupling element 30 may result in constant contact between the lip 36 of the coupling element 30 and the outward tapered surface 47 of the post 40. However, the biasing force of the extending annular surface 256, or biasing element 255, should not (significantly) hinder or prevent the rotational movement of the coupling element 30 (i.e. rotation of the coupling element 30 about the post 40). Because connector 200 may include connector body 250 having an extended, resilient annular surface 256 to improve continuity, there may be no need for an additional component such as a metallic conductive continuity member that is subject to corrosion and permanent deformation during operable advancement and disengagement with an interface port 20, which may ultimately adversely affect the signal quality (e.g. corrosion or deformation of conductive member may degrade the signal quality)

Furthermore, the connector body 250 may include a semi-rigid, yet compliant outer surface 254, wherein the outer surface 254 may be configured to form an annular seal when the first end 251 is deformably compressed against a received coaxial cable 10 by operation of a fastener member 60. Further still, the connector body 250 may include internal surface features 259, such as annular serrations formed near or proximate the internal surface of the first end 251 of the connector body 250 and configured to enhance frictional restraint and gripping of an inserted and received coaxial cable 10, through tooth-like interaction with the cable. The connector body 250 may be formed of materials such as plastics, polymers, bendable metals or composite materials that facilitate a semi-rigid, yet compliant outer surface 254. Further, the connector body 250 may be formed of conductive or non-conductive materials or a combination thereof. Manufacture of the connector body 250 may include casting, extruding, cutting, turning, drilling, knurling, injection molding, spraying, blow molding, component overmolding, combinations thereof, or other fabrication methods that may provide efficient production of the component.

Further embodiments of connector 200 may include a connector body member 90 formed of a conductive or non-conductive material. Such materials may include, but are not limited to conductive polymers, plastics, elastomeric mixtures, composite materials having conductive properties, soft metals, conductive rubber, rubber, and/or the like and/or any workable combination thereof. The connector body member 90 may comprise a substantially circinate torus or toroid structure, or other ring-like structure. For example, an embodiment of the connector body member 90 may be an O-ring disposed proximate the second end 252 of connector body 250 and the cavity 38 extending axially from the edge of first end 31 and partially defined and bounded by an outer internal wall 39 of coupling element 30 (see FIG. 4) such that the connector body O-ring 90 may make contact with and/or reside contiguous with the extended annular surface 256 of connector body 250 and outer internal wall 39 of coupling element 30 when operably attached to post 40 of connector 200. The connector body member 90 may facilitate an annular seal between the coupling element 30 and connector body 250 thereby providing a physical barrier to unwanted ingress of moisture and/or other environmental elements. Moreover, the connector body member 90 may facilitate further electrical coupling of the connector body 250 and coupling element 30 by extending therebetween an unbroken electrical circuit if connector body member 90 is conductive (i.e. formed of conductive materials). In addition, the connector body member 90 may further facilitate grounding of the connector 200, and attached coaxial cable 10 by extending the electrical connection between the connector body 250 and the coupling element 30. Furthermore, the connector body member 90 may effectuate a buffer preventing ingress of electromagnetic noise between the coupling element 30 and the connector body 250. It should be recognized by those skilled in the relevant art that the connector body member 90 may be manufactured by extruding, coating, molding, injecting, cutting, turning, elastomeric batch processing, vulcanizing, mixing, stamping, casting, and/or the like and/or any combination thereof in order to provide efficient production of the component.

Referring to FIGS. 1-9, a method of facilitating continuity through a coaxial cable connector 100 may include the steps of providing a post 40 having a first end 41, a second end 42, and a flange 45 proximate the second end 42, wherein the post 40 is configured to receive a center conductor 18 surrounded by a dielectric 16 of a coaxial cable 10, a connector body 50 attached to the post 40, and a coupling element 30 attached to the post 40, the coupling element 30 having a first end 31 and a second end 32, and disposing a biasing member 70 within a cavity 38 formed between the first end 31 of the coupling element 30 and the connector body 50 to bias the coupling element 30 against the post 40. Furthermore, a method of facilitating continuity through a coaxial cable connector 200 may include the steps of providing a post 40 having a first end 41, a second end 42, and a flange 45 proximate the second end 42, wherein the post 40 is configured to receive a center conductor 18 surrounded by a dielectric 16 of a coaxial cable 10, a coupling element 30 attached to the post 40, the coupling element 30 having a first end 31 and a second end 32, and a connector body 250 having a first end 251, a second end 252, and an annular surface 256 proximate the second end of the connector body, and extending the annular surface 256 a radial distance to engage the coupling element 30, wherein the engagement between the extended annular surface 256 and the coupling element 30 biases the coupling element 30 against the post 40.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A coaxial cable connector comprising:

a post having a first end, a second end, and a flange, wherein the first end is configured to receive a center conductor surrounded by a dielectric of a coaxial cable;

a connector body having a first end and a second end, and a body contact surface, the first end configured to receive a portion of the coaxial cable and the second end configured to engage the post when the connector is in an assembled state;

a coupling element configured to engage the post and axially move between a first position, where the coupling element is partially tightened on an interface port, and a second position, where the coupling element is fully tightened on the interface port, the second position being axially spaced from the first position, the coupling element having a first end, a second end, an internal lip having a lip contact surface extending along a radial direction and facing a rearward direction, and an outer internal wall surface extending along an axial direction substantially perpendicular to the radial direction so as to form a cavity between the coupling element and the connector body, the cavity being configured to allow electrical grounding between the coupling element and the post to be interrupted during operation of the connector when the coupling element moves out of electrical contact with the post and when the coupling element is in the first position, where the coupling element is partially tightened on an interface port;

a biasing member configured to be compressed in the cavity so as to exert an axial biasing force between the lip contact surface of the coupling element and the body contact surface of the connector body and biasingly maintain electrical grounding between the coupling element and post during operation of the connector, the axial biasing force being sufficient to biasingly urge the coupling element toward the post and biasingly restrain the cavity from allowing electrical grounding between the coupling element and the post to be interrupted during operation of the connector by biasingly maintaining the internal lip of the coupling element in electrical contact with the flange of the post when the coupling element is in the first position, where the coupling element is partially tightened on an interface port;

wherein the biasing member is configured to provide a physical seal between the coupling element and the connector body when the biasing member is compressed in the cavity;

wherein the biasing member is an O-ring, and is made of substantially non-metallic and non-conductive material;

wherein the biasing member is simultaneously compressed by at least the lip contact surface of the internal lip of the coupling element and the body contact surface of the connector body when the biasing member is compressed in the cavity;

wherein the biasing member includes a first portion configured to be compressed by the lip contact portion of the internal lip of the coupling element when the biasing member is compressed in the cavity, a second portion configured to be compressed by the body contact surface of the connector body when the biasing member is compressed in the cavity, and a third portion configured to be compressed when the biasing member is compressed in the cavity; and wherein the first, second, and third portions of the biasing member cause the axial biasing force to be exerted between the lip contact surface of the coupling element and the body contact surface of the connector body so as to biasingly maintain electrical grounding between the coupling element and the post during operation of the connector.

2. The connector of claim 1, wherein the connector body includes an outward facing surface, and the third portion of the biasing member is configured to be compressed by the outward facing surface of the connector body when the biasing member is compressed within the cavity.

3. The connector of claim 1, wherein the biasing member includes a fourth portion configured to be compressed when the biasing member is compressed in the cavity.

4. The coaxial cable connector of claim 3, wherein the fourth portion of the biasing member is configured to be compressed by the outer internal wall surface of the coupling element when the biasing member is compressed in the cavity.

5. The connector of claim 1, wherein the biasing member is an over-sized O-ring having an uncompressed diameter greater than an axial space formed by the cavity between the lip contact surface of the coupling element and the body contact surface of the connector body during operation of the connector when the coupling element is in the first position, where the coupling element is partially tightened on an interface port.

6. The connector of claim 1, wherein the biasing member is an over-sized O-ring having an uncompressed diameter greater than an axial space formed by the cavity between the lip contact surface of the coupling element and the body contact surface of the connector body throughout all ranges of motion of the coupling element and the connector body relative to one another during operation of the connector when the coupling element is in the first position, where the coupling element is partially tightened on an interface port.

7. The connector of claim 1, wherein the biasing member is configured to biasingly maintain electrical grounding between the coupling element and the post during operation of the connector only when the biasing force is greater than a counter force exerted against the connector body along the axial direction.

8. The connector of claim 1, wherein the cavity is configured to decrease in size when the coupling element moves toward the connector body so as to further compress the biasing member in the cavity and further cause the biasing member to exert the axial biasing force so to biasingly maintain electrical grounding between the coupling element and the post during operation of the connector and when the coupling element moves toward the connector body.

9. The connector of claim 1, wherein the cavity is configured to decrease in size when the coupling element moves toward the connector body so as to further compress the biasing member and cause the biasing member to exert a resultant axial biasing force between the coupling element and the post during operation of the connector and when the coupling element moves toward the connector body.

10. The connector of claim 1, wherein the cavity forms an axial space extending between the lip contact surface of the coupling element and the body contact surface of the connector body, and the biasing member comprises an over-sized O-ring having an uncompressed axial length greater than the axial space formed by the cavity such that the biasing member remains compressed in the cavity throughout all ranges of motion of the coupling element and the connector body relative to one another during operation of the connector when the coupling element is in the first position, where the coupling element is partially tightened on an interface port.

11. A coaxial cable connector for coupling an end of a coaxial cable and facilitating electrical connection with a coaxial cable interface port having a conductive surface, the coaxial cable having a center conductor surrounded by a dielectric, the dielectric being surrounded by a conductive grounding shield, the conductive grounding shield being surrounded by a protective outer jacket, the connector comprising:

a post having a first end, a second end, and a flange proximate the second end, the post configured to receive the center conductor and the dielectric of the coaxial cable;

a connector body having a first end and a second end, the first end configured to receive a prepared end of the coaxial cable and the second end configured to engage the post, the second end having an outer annular recess including a forward facing body contact surface and an outwardly facing wall surface extending forwardly from the forward facing body contact surface along an axial direction;

a coupling element rotatably attached to the post, the coupling element having a first end configured to mate with the connector body and a second end configured to mate with an interface port, the first end defining a lip contact surface extending radially inwardly and facing in a rearward direction, and an inwardly facing wall surface extending rearwardly from the lip contact surface in an axial direction;

a biasing member configured to be received within a cavity formed between the coupling element and the connector body, the cavity being bounded by at least the lip contact surface of the second end of the coupling element and the body contact surface of the connector body;

wherein the lip contact surface of the coupling element is spaced from the body contact surface of the connector body so as to form an axial gap between the lip contact surface of the coupling element and the body contact surface of the connector body;

wherein the axial gap is configured to vary in size when the coupling element and the connector body move toward and away from one another during operation of the connector and when the connector is not fully tightened on the interface port;

wherein the biasing member is configured to be simultaneously compressed between at least the lip contact surface of the coupling element and the body contact surface of the connector body so as to exert a biasing force on the lip contact surface of the coupling element in an axial direction and axially bias the coupling element toward the post in order to inhibit interruption of an electrical ground path between the coupling element and the post during operation of the connector and when the connector is not fully tightened on the interface port;

wherein the biasing member has an O-ring shape, is comprised of a resilient, non-metallic and non-conductive material, and is configured to form a physical seal against the body contact surface of the connector body; and wherein the biasing member includes a first portion configured to be compressed by the lip contact surface of the coupling element, a second portion configured to be compressed by the body contact surface of the connector body, and a third portion, and wherein the first, second, and third portions of the biasing member cause the axial biasing force to be exerted between the lip contact surface of the coupling element and the body contact surface of the connector body so as to biasingly maintain electrical grounding between the coupling element and the post during operation of the connector and when the connector is not fully tightened on the interface port.

12. The connector of claim 11, wherein the connector body includes an outward facing surface, and the third portion of the biasing member is configured to be compressed by the outward facing surface of the connector body when the biasing member is compressed within the cavity.

13. The connector of claim 11, wherein the biasing member is an over-sized O-ring having a uncompressed diameter greater than the axial gap between the lip contact surface of the coupling element and the body contact surface of the connector body.

14. The connector of claim 11, wherein the biasing member is an over-sized O-ring having a first diameter when the over-sized O-ring is an uncompressed state and having a second diameter when the over-sized O-ring is in the compressed state, the first diameter being greater than the second diameter, and the first diameter being greater than the axial gap between the lip contact surface of the coupling element and the body contact surface of the connector body throughout all ranges of motion of the coupling element and the connector body relative to one another during operation of the connector when the coupling element is in the first position, where the coupling element is partially tightened on an interface port.

15. The connector of claim 11, wherein the biasing member is configured to biasingly maintain electrical grounding between the coupling element and the post during operation of the connector only when the biasing force is greater than a counter force exerted against the connector body along the axial direction.

16. The connector of claim 11, wherein the axial gap is configured to decrease in size when the coupling element moves toward the connector body so as to further compress the biasing member in the cavity and further cause the biasing member to exert the axial biasing force so to biasingly maintain electrical grounding between the coupling element and the post during operation of the connector and when the coupling element moves toward the connector body.

17. The connector of claim 11, wherein the axial gap is configured to decrease in size when the coupling element moves toward the connector body so as to further compress the biasing member and cause the biasing member to exert a resultant axial biasing force between the coupling element and the post during operation of the connector and when the coupling element moves toward the connector body.

18. The connector of claim 11, wherein the biasing member includes a fourth portion configured to be compressed when the biasing member is compressed in the cavity.

19. The connector of claim 18, wherein the fourth portion of the biasing member is configured to be compressed by the inwardly facing wall surface of the coupling element during operation of the connector and when the connector is not fully tightened on the interface port.

* * * * *